US011513454B1

(12) United States Patent
Hayashi et al.

(10) Patent No.: US 11,513,454 B1
(45) Date of Patent: Nov. 29, 2022

(54) CONDUCTIVE ROLL, TRANSFER DEVICE, PROCESS CARTRIDGE, AND IMAGE FORMING APPARATUS FOR IMAGE TRANSFER

(71) Applicant: FUJIFILM Business Innovation Corp., Tokyo (JP)

(72) Inventors: Shogo Hayashi, Kanagawa (JP); Minoru Rokutan, Kanagawa (JP); Takuro Hoshio, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 17/498,733

(22) Filed: Oct. 11, 2021

(30) Foreign Application Priority Data

Jun. 30, 2021 (JP) ..... JP2021-109501

(51) Int. Cl.
*G03G 15/16* (2006.01)
*G03G 15/02* (2006.01)
*G03G 15/08* (2006.01)

(52) U.S. Cl.
CPC ..... *G03G 15/1685* (2013.01); *G03G 15/0233* (2013.01); *G03G 15/0818* (2013.01); *G03G 15/162* (2013.01)

(58) Field of Classification Search
CPC ..... G03G 15/0233; G03G 15/0818; G03G 15/162; G03G 15/1685
See application file for complete search history.

(56) References Cited

U.S. PATENT DOCUMENTS 6,020,054 A * 2/2000 Masuda ..... G03G 15/0233 428/323
2003/0118372 A1* 6/2003 Kitano ..... G03G 15/1685 399/176

FOREIGN PATENT DOCUMENTS

| | | |
|---|---|---|
| JP | 2009244824 | 10/2009 |
| JP | 4654729 | 3/2011 |
| JP | 2014071147 | 4/2014 |
| JP | 2014126602 | 7/2014 |
| JP | 6507223 | 4/2019 |

* cited by examiner

*Primary Examiner* — Joseph S Wong
(74) *Attorney, Agent, or Firm* — JCIPRNET

(57) ABSTRACT

A conductive roll includes a support member, an elastic layer disposed on an outer peripheral surface of the support member, a surface layer disposed on an outer peripheral surface of the elastic layer, and an intermediate layer disposed between the elastic layer and the surface layer, the intermediate layer having a Poisson ratio of 0.40 or less.

14 Claims, 4 Drawing Sheets

CONDUCTIVE ROLL, TRANSFER DEVICE, PROCESS CARTRIDGE, AND IMAGE FORMING APPARATUS FOR IMAGE TRANSFER

CROSS-REFERENCE TO RELATED APPLICATIONS

This application is based on and claims priority under 35 USC 119 from Japanese Patent Application No. 2021-109501 filed Jun. 30, 2021.

BACKGROUND

(i) Technical Field

The present invention relates to a conductive roll, a transfer device, a process cartridge, and an image forming apparatus.

(ii) Related Art

JP2014-126602A proposed the followings. "A transfer roll that includes a conductive support, a conductive elastic layer provided on the conductive support, and a conductive resin layer configured to be provided on the conductive elastic layer and to contain a resin material and a conductive agent. The conductive resin layer has a first region forming the outermost surface and a second region which is provided between the first region and the conductive elastic layer to be in contact with the conductive elastic layer and has a surface resistivity lower than a surface resistivity of the first region. A nip is formed to have an inclination of a bite amount in an axial direction. In a case where a recording medium is inserted into the nip, a difference between a transport amount at a portion at which the bite amount is 0.5 mm and a transport amount at a portion at which the bite amount is 1.3 mm is 1.5 mm or more/400 mm.

JP2014-071147A proposed the followings. "A toner supply roll for electrophotographic equipment is a toner supply roll having a shaft body and a roll-like polyurethane foam formed on an outer periphery of the shaft body. The polyurethane foam has a storage elastic modulus which is equal to or more than of 100 kPa and includes a surface cell and a central cell that communicate with each other. An average cell diameter of the central cell is 200 to 1000 μm. A relation between a curved-surface pressing nip width and a flat-surface pressing nip width satisfies the following expression (1). The curved-surface pressing nip width is a nip width when being pressed on a curved surface. The flat-surface pressing nip width is a nip width when being pressed on a flat surface.

$$\text{Curved-surface pressing nip width} \geq (\text{flat-surface pressing nip width} \times 0.65) \quad (1)\text{"}$$

SUMMARY

Aspects of non-limiting embodiments of the present disclosure relate to a conductive roll, a transfer device, a process cartridge, and an image forming apparatus that easily increase a parallelism of an image transferred to a recording medium in comparison to a case where a Poisson ratio of an intermediate layer is greater than 0.40, in a conductive roll including a support member, an elastic layer disposed on an outer peripheral surface of the support member, a surface layer disposed on an outer peripheral surface of the elastic layer, and an intermediate layer disposed between the elastic layer and the surface layer.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a conductive roll including a support member, an elastic layer disposed on an outer peripheral surface of the support member, a surface layer disposed on an outer peripheral surface of the elastic layer, and an intermediate layer disposed between the elastic layer and the surface layer, the intermediate layer having a Poisson ratio of 0.40 or less.

BRIEF DESCRIPTION OF THE DRAWINGS

Exemplary embodiment(s) of the present invention will be described in detail based on the following figures, wherein.

DETAILED DESCRIPTION

Figure 1A:
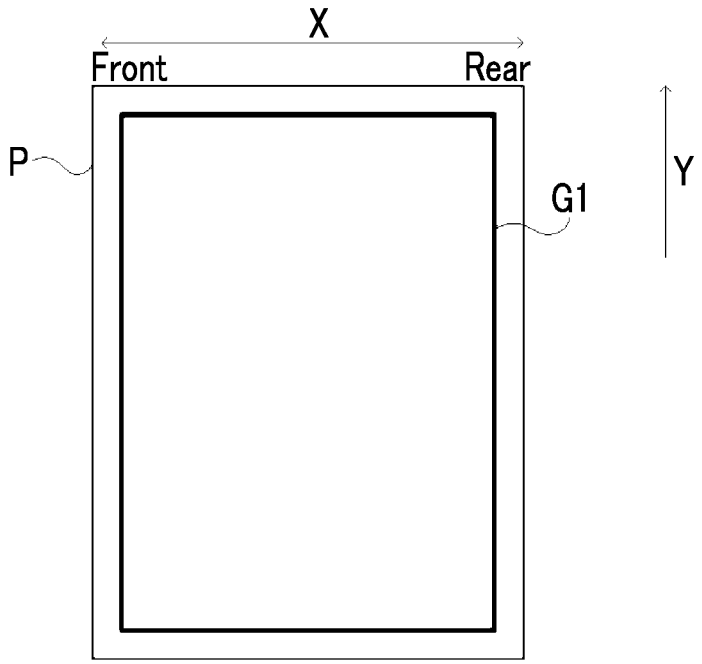
FIGS. 1A and 1B are schematic diagrams illustrating parallelism of an image transferred to a recording medium.

Hereinafter, an exemplary embodiment of the present disclosure will be described. Descriptions and examples illustrate the exemplary embodiment and do not limit the scope of the embodiments.

The numerical range indicated by using "to" in the present disclosure indicates a range including the numerical values before and after "to" as the minimum value and the maximum value, respectively.

In the numerical range described stepwise in the present disclosure, an upper limit value or a lower limit value described in one numerical range may be replaced with an upper limit value or a lower limit value of another numerical range described stepwise. In the numerical range described in the present disclosure, an upper limit value or a lower limit value of the numerical range may be replaced with value described in the examples.

In the present disclosure, the term "step" includes an independent process. In addition, even in a case where it is not possible to clearly distinguish a step from another step, this step is included in this term so long as the intended purpose of this step is achieved.

In a case where the exemplary embodiment is described with reference to the drawings in the present disclosure, the configuration of the embodiment is not limited to the configuration illustrated in the drawings. The size of the member in each drawing is conceptual, and the relative relation between the sizes of the members is not limited to the illustrations.

In the present disclosure, a component may contain a plurality of types of applicable substances. In a case where a plurality of types of substances applicable to each component in a composite are provided, the amount of each component in the composite in the present disclosure means the total amount of the plurality of types of substances provided in the composite unless otherwise specified.

Conductive Roll

According to the present exemplary embodiment, a conductive roll includes a support member, an elastic layer disposed on an outer peripheral surface of the support member, a surface layer disposed on an outer peripheral surface of the elastic layer, and an intermediate layer disposed between the elastic layer and the surface layer, the intermediate layer having a Poisson ratio of 0.40 or less.

The use of the conductive roll according to the present exemplary embodiment is not particularly limited so long as the conductive roll is used to press an outer peripheral surface onto a facing roll to form an insertion portion into which a recording medium is to be inserted, and to transfer an image to a recording medium at the insertion portion. That is, the conductive roll according to the present exemplary embodiment is used to press the outer peripheral surface onto the facing roll, insert a recording medium into the pushed region as an insertion portion, and transfer an image to the recording medium at the insertion portion.

Although not particularly limited, the conductive roll according to the present exemplary embodiment is used as a transfer roll, for example, in an electrophotographic image forming apparatus. The use of the conductive roll according to the present exemplary embodiment is not limited to the above description, and a peeling roll, a backup roll, and a tension roll, and the like are exemplified.

With the above configuration, the conductive roll according to the present exemplary embodiment can easily increase the parallelism of an image transferred to a recording medium. The reason is presumed as follows.

In a case where the outer peripheral surface of the conductive roll is pressed on the facing roll, the insertion portion into which a recording medium is inserted is formed, and an image is transferred to the recording medium at the insertion portion, the parallelism of the image transferred to the recording medium may decrease.

Figure 1B:
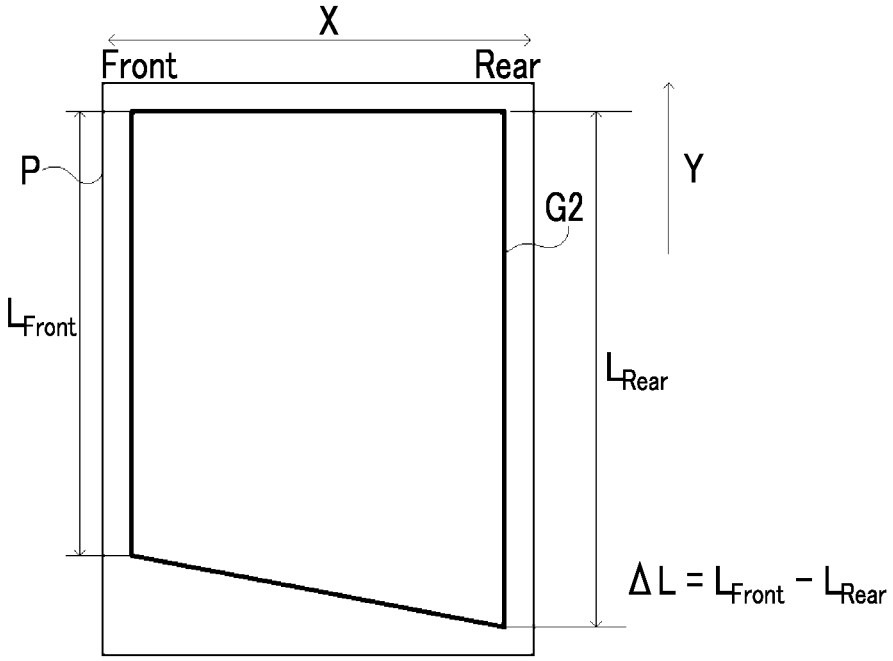

Here, the parallelism of the transferred image means a degree of the image being parallel to a direction (direction indicated by an arrow X in FIGS. 1A and 1B) perpendicular to a transport direction (direction indicated by an arrow Y in FIGS. 1A and 1B) of a recording medium P at the insertion portion. Specifically, the parallelism of the transferred image is represented, for example, by a difference $\Delta L$ ($=L_{Front}-L_{Rear}$) between a line image length $L_{Front}$ on one end side (denoted by Front in FIGS. 1A and 1B) in the direction indicated by the arrow X and a line image length $L_{Rear}$ on the other end side (denoted by Rear in FIGS. 1A and 1B) as illustrated in FIG. 1B, which are obtained from an image G2 actually transferred onto the recording medium P in a case where a rectangular image G1 configured by sides respectively parallel to sides of the recording medium P is intended to be formed on the recording medium P as illustrated in FIG. 1A.

As a method of correcting $\Delta L$ described above, a method of adjusting the pushing amount of the conductive roll into the facing roll at both ends of the conductive roll in an axial direction and making a different in a transport amount of a recording medium in the direction perpendicular to the transport direction of the recording medium is exemplified.

Thus, in the conductive roll, the Poisson ratio of the intermediate layer disposed between the elastic layer and the surface layer is set to be equal to or less than 0.40 to facilitate deformation. Because the intermediate layer is easily deformed, the pushing amount of the conductive roll into the facing roll can be increased, and it is easy to adjust the pushing amount at both ends of the conductive roll in the axial direction.

Therefore, it is presumed that the conductive roll according to the present exemplary embodiment easily increases the parallelism of the image transferred to the recording medium.

In the conductive roll according to the present exemplary embodiment, for example, the Poisson ratio of the intermediate layer is preferably equal to or less than 0.4, and more preferably equal to or less than 0.38, from a viewpoint of easily increasing the parallelism of an image transferred to a recording medium.

In a case where the Poisson ratio of the intermediate layer is too low, the compression deformation of the intermediate layer becomes large. Thus, the Poisson ratio of the intermediate layer is preferably equal to or more than 0.3, for example, from a viewpoint of reducing an effect of controlling a paper passing speed.

Here, the Poisson ratio is measured in a manner as follows.

The composition of the intermediate layer is analyzed from a target conductive roll.

A strip that has the same composition as the analyzed intermediate layer and has a width of 10 mm, a thickness of 1 mm, and an inter-mark line distance of 40 mm is prepared and is mounted on a tension tester. The width of the strip at a distance of 20 mm from the lower end of the mark line is measured with a laser. The lateral strain $\varepsilon b$ is obtained from the width of the strip in a case where the strip is pulled by 30% at a tensile speed of 10 mm/min. Then, the longitudinal strain $\varepsilon L$ from the tensile direction is obtained from $\varepsilon b/\varepsilon L$ at the time at which the longitudinal strain $\varepsilon L$ is obtained.

The conductive roll according to the present exemplary embodiment will be described with reference to the drawings.

Figure 2:
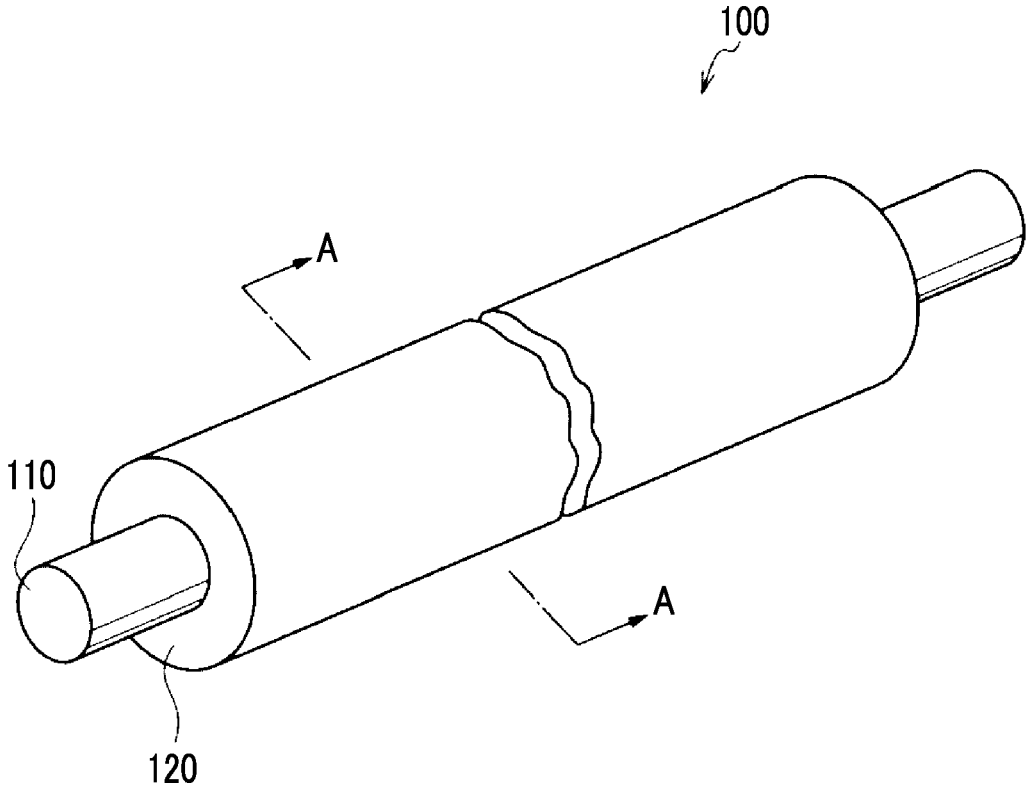
FIG. 2 is a schematic perspective view illustrating an example of a conductive roll according to an exemplary embodiment.
Figure 3:
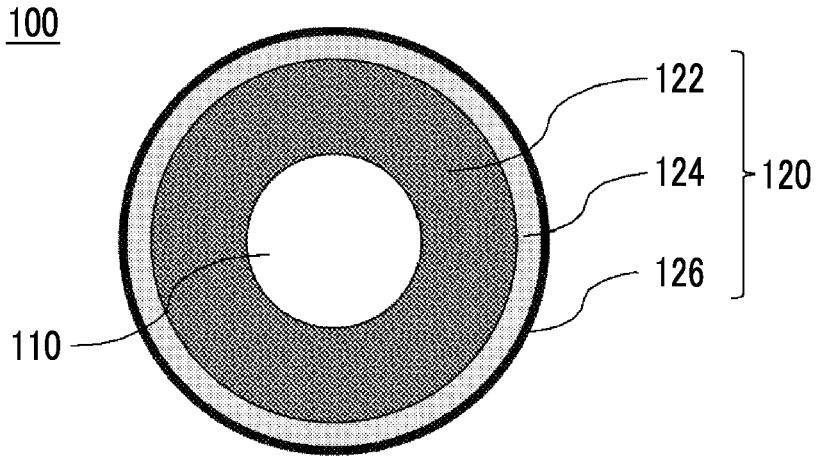
FIG. 3 is a schematic cross-sectional view illustrating an example of the conductive roll in the present exemplary embodiment, and is a cross-sectional view taken along line III-III in FIG. 2.

FIG. 2 is a schematic perspective view illustrating an example of the conductive roll according to the present exemplary embodiment. FIG. 3 is a cross-sectional view taken along line III-III in FIG. 2 and is a cross-sectional view obtained by cutting the conductive roll illustrated in FIG. 2 in a radial direction.

As illustrated in FIG. 2, a conductive roll 100 is a roll member configured to include a columnar support member 110 and a layered object 120. The layered object 120 includes an elastic layer, an intermediate layer, and a surface layer, which are disposed on an outer peripheral surface of the support member 110. As illustrated in FIG. 3, regarding the layer structure of the conductive roll 100, the conductive roll includes an elastic layer 122 disposed on the outer peripheral surface of the columnar support member 110, an intermediate layer 124 disposed on the outer peripheral surface of the elastic layer 122, and a surface layer 126 disposed on the outer peripheral surface of the intermediate layer 124.

The conductive roll according to the present exemplary embodiment is not limited to the configuration illustrated in FIGS. 2 and 3. For example, an adhesive layer may be appropriately provided between the support member 110 and the elastic layer 122, between the elastic layer 122 and the intermediate layer 124, or between the intermediate layer 124 and the surface layer 126.

Materials and the like of each layer forming the conductive roll according to the present exemplary embodiment will be described below.

Support Member

In the conductive roll according to the present exemplary embodiment, the support member may be a member that functions as a support member of the conductive roll.

The support member may be a hollow member (that is, cylindrical member) or a solid member (that is, columnar member).

In a case where an electric field is formed between the conductive roll and the facing roll, the support member is preferably a conductive support member, for example.

Examples of the conductive support member include metal members made of iron (free-cutting steel and the like), copper, brass, stainless steel, aluminum, and nickel; resin members or ceramic members having an outer surface which is plated; and resin members or ceramic members containing a conductive agent.

The outer diameter of the support member may be determined in accordance with the use of the conductive roll.

For example, in a case where the conductive roll according to the present exemplary embodiment is a secondary transfer roll, the outer diameter of the support member may be equal to or more than 3 mm and equal to or less than 30 mm as an example.

Elastic Layer

The elastic layer is, for example, configured to contain an elastic material, a conductive agent, and, as necessary, other additives.

Examples of the elastic material include isoprene rubber, chloroprene rubber, epichlorohydrin rubber, butyl rubber, polyurethane, silicone rubber, fluororubber, styrene-butadiene rubber, butadiene rubber, nitrile rubber, ethylene propylene rubber, epichlorohydrin-ethylene oxide copolymer rubber, epichlorohydrin-ethylene oxide-allyl glycidyl ether ternary copolymer rubber, ethylene-propylene-diene ternary copolymer rubber (EPDM), acrylonitrile-butadiene copolymer rubber (NBR), natural rubber, and rubber obtained by mixing the above substances.

Examples of the conductive agent include an electronic conductive agent and an ionic conductive agent. Examples of the electronic conductive agent include powders of carbon blacks such as Ketjen black and acetylene black; thermally decomposed carbon and graphite; various conductive metals or alloys such as aluminum, copper, nickel, and stainless steel; various conductive metal oxides such as tin oxide, indium oxide, titanium oxide, tin oxide-antimony oxide solid solutions, and tin oxide-indium oxide solid solutions; and substances obtained by performing conduction treatment on a surface of an insulating material. Examples of the ionic conductive agent include perchlorates and chlorates such as tetraethylammonium and lauryl trimethylammonium; and alkali metals such as lithium and magnesium, and perchlorates and chlorates of alkaline earth metals.

Such a conductive agent may be used singly or in combination of two or more types.

Examples of the other additives include known materials that may be added to an elastic body, for example, softeners, plasticizers, curing agents, vulcanizing agents, vulcanization accelerators, antioxidants, surfactants, coupling agents, and fillers (silica, calcium carbonate, and the like).

For example, the elastic layer is preferably configured to include a cylindrical elastic foam and a conductive coating layer that covers the exposed surface of the elastic foam.

In the elastic layer having such a configuration, the intended conductivity is imparted by the conductive coating layer, and a soft elastic layer may be obtained in comparison to a case where a conductive agent is contained in the elastic foam. In a case where the elastic layer includes the elastic foam and the conductive coating layer, the elastic layer also easily deforms in a case where the conductive roll is pushed into the facing roll. Thus, it is easy to obtain a conductive roll that easily increases the parallelism of an image transferred to a recording medium.

Elastic Foam

The elastic foam forming the elastic layer is a foam containing an elastic material (also referred to as a rubber material).

As the elastic material, the above-described substances are applied.

Examples of a foaming agent for obtaining the elastic foam include water; azo compounds such as azodicarbonamide, azobisisobutyronitrile, and diazoaminobenzene; benzene sulfonyl hydrazides such as benzene sulfonyl hydrazide, 4,4'-oxybisbenzene sulfonyl hydrazide, and toluene sulfonyl hydrazide; bicarbonates such as sodium hydrogen carbonate that generate carbon dioxide by thermal decomposition; mixtures of $NaNO_2$ and $NH_4Cl$ that generate a nitrogen gas; and peroxides that generate oxygen.

In order to obtain the elastic foam, as necessary, a foaming aid, a foam stabilizer, a catalyst, and the like may be used.

The elastic foam may contain a conductive agent from a viewpoint of controlling the conductivity of the elastic layer.

Examples of the conductive agent contained in the elastic foam include an electronic conductive agent and an ionic conductive agent.

From a viewpoint of obtaining a conductive roll that easily increases the parallelism of an image transferred to a recording medium, the content of the conductive agent (particularly, in the case of an electronic conductive agent) in the elastic foam is, for example, equal to or less than 1% by mass, preferably equal to or less than 0.5% by mass, and more preferably equal to or less than 0% by mass, with respect to the total mass of the elastic foam.

For example, that is, it is favorable that the amount of the electronic conductive agent in the elastic foam is small. Even in a case where the elastic foam contains conductive particles, the content of the electronic conductive agent is intended to be equal to or less than 1% by mass with respect to the total mass of the elastic foam.

In a case where the elastic foam contains particulates of the electronic conductive agent, the filler, and the like described above, the hardness of the elastic layer tends to increase, and the peelability of the medium tends to decrease. Therefore, for example it is preferably that the amount of the particulates in the elastic foam is small. Even in a case where the elastic foam contains conductive particles, the total content of the particulates may be, equal to or less than 1% by mass with respect to the total mass of the elastic foam.

For example, the bubble structure in the elastic foam is preferably an open cell structure from a viewpoint of the formability of the conductive coating layer and from a viewpoint of obtaining the conductive roll that easily increases the parallelism of an image transferred to a recording medium.

Here, the open cell structure means a structure in which adjacent cells (that is, bubbles) communicate with each other and a portion of the communicating cell is exposed (open) to the surface.

The elastic foam having a small closed cell ratio is favorable, and the closed cell ratio is preferably, for example, equal to or less than 50% (preferably, equal to or less than 30%).

For example, from a viewpoint of the formability of the conductive coating layer and from a viewpoint of obtaining the conductive roll that easily increases the parallelism of an image transferred to a recording medium, the cell diameter (also referred to as a bubble diameter) of the elastic foam is preferably equal to or more than 50 μm and equal to or less than 1000 μm, more preferably equal to or more than 100 μm and equal to or less than 800 μm, and further equal to or more than 150 μm and equal to or less than 600 μm.

For example, from a viewpoint of the formability of the conductive coating layer and from a viewpoint of obtaining the conductive roll that easily increases the parallelism of an image transferred to a recording medium, the density (also referred to as a bubble ratio) of the elastic foam is preferably equal to or more than 50 $kg/m^3$ and equal to or less than 90 $kg/m^3$, more preferably equal to or more than 55 $kg/m^3$ and equal to or less than 85 $kg/m^3$, and further equal to or more than 60 $kg/m^3$ and equal to or less than 80 $kg/m^3$.

Here, the cell diameter (bubble diameter), a foaming ratio (bubble ratio), and the closed cell ratio in the elastic foam are measured in a manner as follows.

First, a cross section of the elastic layer (elastic foam in the elastic layer) in a thickness direction is produced using a razor. Four cross sections in total are produced in parallel with the axial direction of the conductive roll and in 90° increments in a circumferential direction.

The central portion of the cross section in the axial direction is photographed with a laser microscope (KEYENCE CORPORATION, VK-X200) to acquire an image. The image is analyzed with image analysis software (Media Cybernetics, Image-Pro Plus), and the maximum diameter and the area of the cell (bubble) are measured.

In a case where the elastic foam has an open cell structure, the continuous state of cells (bubbles) is estimated from the shape of open cells. The cells which are continuous (connected) are pseudo-separated from each other, and the maximum diameter of the separated cell is obtained. That is, in a case where it is presumed that the open cells have a shape in which, for example, five bubbles are continuous (connected), the five cells are pseudo-separated into five, and the maximum diameter of the separated five cells is measured.

The arithmetic mean of the maximum diameter of 100 cells which are randomly selected is calculated in the analyzed cross-sectional image, and the arithmetic mean of four cross-sections is calculated based on the obtained value. The value obtained in this manner is set to the cell diameter.

The foaming ratio is obtained by (total area of cells in the analyzed cross-sectional image)/(total area of the analyzed cross-sectional image)×100.

The closed cell ratio is obtained by (total area of closed cells in the analyzed cross-sectional image)/(total area of bubbles in the analyzed cross-sectional image)×100.

Here, the closed cells refer to bubbles that are all surrounded by a wall surface in the cross-sectional image.

The density of the elastic foam is measured in a manner as follows.

A cube is produced using the elastic layer (elastic foam in the elastic layer) and a razor. In a case where the cube is produced as large as possible, the density can be measured accurately. Then, the length, the width, and the height of the cube are measured, and the volume is calculated. Then, the weight is measured, and the density is obtained from the weight/volume.

Young's Modulus of Elastic Layer

For example, in the conductive roll according to the present exemplary embodiment, from a viewpoint of obtaining the conductive roll that easily increases the parallelism of an image transferred to a recording medium, the Young's modulus of the elastic layer is preferably equal to or more than 50 kPa and equal to or less than 500 kPa, more preferably equal to or more than 60 kPa and equal to or less than 300 kPa, and further equal to or more than 80 kPa and equal to or less than 150 kPa.

The Young's modulus is easily achieved by reducing the content of the particulates (for example, electronic conductive agent and filler) in the elastic foam.

The Young's modulus is measured in a manner as follows.

A method of measuring the Young's modulus basically conforms to ISO527.

The composition of the elastic layer is analyzed from a target conductive roll.

A dumbbell-type tensile test piece that has the same composition as the analyzed elastic layer and has an inter-mark line distance of 50 mm and a thickness of 5 mm is made into a single-layer sheet. A stress (σ)-strain (ε) curve at a tensile speed of 5 mm/min is obtained by a desktop precision universal testing machine (AGS-X; manufactured by Shimadzu Corporation). The stress at the strain of 0.05% to 0.25% is measured, and the Young's modulus is obtained from $\Delta\sigma/\Delta\varepsilon$.

Formation of Elastic Foam

A method of forming the cylindrical elastic foam is not particularly limited, and a known method is used.

For example, methods as follows are exemplified: a method of preparing a composite containing an elastic material, a foaming agent, and other components used as necessary (for example, vulcanizing agent), extruding the composite into a cylindrical shape, and then heating the molded article to perform vulcanization and foaming; and a method of cutting out a large foam into a cylindrical shape.

After a columnar elastic foam is formed, a center hole for inserting the support member may be formed to obtain the cylindrical elastic foam.

After the cylindrical elastic foam is obtained, as necessary, the shape may be further adjusted or post-treatment such as polishing the surface may be performed.

Conductive Coating Layer

The conductive coating layer forming the elastic layer is a conductive layer that covers the exposed surface of the elastic foam (that is, including an inner peripheral surface, an outer peripheral surface, and a cell wall surface of the cylindrical elastic foam, which are contact surfaces of the elastic foam with the atmosphere).

The exposed surface of the elastic foam may be entirely covered by the conductive coating layer, or may be partially covered.

A treatment liquid containing a conductive agent and resin is used to form the conductive coating layer.

Here, examples of the conductive agent used in the treatment liquid include an electronic conductive agent and an ionic conductive agent. Among the agents, the electronic conductive agent is favorable.

The conductive agent contained in the treatment liquid may be one type or two or more types.

Here, examples of the electronic conductive agent are similar to the examples of the electronic conductive agent contained in the elastic foam, and the preferable examples is also similar.

The resin used for the treatment liquid is not particularly limited as long as the resin may be used to form a coating layer on the exposed surface of the elastic foam. Examples of the resin include acrylic resin, urethane resin, fluororesin, and silicone resin. Such resin is preferably used as latex, for example.

Examples of latex include natural rubber latex, butadiene rubber latex, acrylonitrile-butadiene rubber latex, acrylic rubber latex, polyurethane rubber latex, fluororubber latex, and silicone rubber latex, in addition to the above resin latex.

For example, the treatment liquid is preferably an aqueous dispersion liquid containing a conductive agent, resin, and water, that is, the conductive agent and the resin.

The concentrations of the conductive agent and the resin in the treatment liquid may be determined in accordance with the formability of the conductive coating layer, the resistance value intended for the elastic layer, and the like.

Formation of Conductive Coating Layer

The conductive coating layer is formed by applying a treatment liquid to the elastic foam and heating and drying the resultant.

Examples of a method of applying the treatment liquid to the elastic foam include a method of coating the elastic foam with the treatment liquid by spray coating and the like, and a method of immersing the elastic foam in the treatment liquid.

With the above methods, the treatment liquid is impregnated into the surface of the elastic foam and the inside of the bubbles. Then, the elastic foam to which the treatment liquid is adhered is dried by heating or the like to form the conductive coating layer.

As the conductive coating layer, for example, the coating layer and the forming method thereof disclosed in JP2009-244824A and the like may be applied.

In this manner, by forming the conductive coating layer on the exposed surface of the elastic foam, the elastic layer in the conductive roll according to the present exemplary embodiment is formed.

Volume Resistance Value of Elastic Layer

In the conductive roll according to the present exemplary embodiment, for example, the volume resistance value of the elastic layer in a case where a voltage of 10 V is applied is preferably equal to or less than 105Ω, more preferably equal to or more than 101Ω and equal to or less than 105Ω, and further preferably equal to or more than 102Ω and equal to or less than 104Ω.

Here, the volume resistance value of the elastic layer is measured in a manner as follows.

First, a roll member in which an elastic layer to be measured is provided on the outer periphery of a conductive support member is produced, and the volume resistance value of the elastic layer is measured using the obtained roll member. In a case where the conductive roll according to the present exemplary embodiment includes a conductive support member, a roll member in which a top layer is peeled off from the conductive roll may be measured.

The roll member is placed on a metal plate such as a copper plate with a load of 500 g on both end portions of the roll member. A voltage (V) of 10 V (in the case of the elastic layer) is applied between the conductive support member of the roll member and the metal plate, by using a minute current measuring device (R8320 manufactured by Advantest CORPORATION). Then, a current value I (A) after seconds is read, and the volume resistance value is obtained by calculation with the following expression.

Expression: Volume resistance value Rv (Ω)=$V/I$

The measurement is performed under an environment of a temperature of 22° C. and humidity of 55% RH.

Thickness of Elastic Layer

In the conductive roll according to the present exemplary embodiment, the thickness of the elastic layer may be determined in accordance with the use of the conductive roll.

For example, in a case where the conductive roll according to the present exemplary embodiment is a secondary transfer roll, the thickness of the elastic layer may be equal to or more than 1 mm and equal to or less than 10 mm as an example.

Intermediate Layer

The intermediate layer is a layer disposed between the elastic layer and the surface layer.

The intermediate layer is configured to contain a soft binder material having a Poisson ratio in the above range.

The binder material is not particularly limited as long as the material has a Poisson ratio in the above range. Examples of the binder material include resin and an elastic material that may be used to form the intermediate layer. Examples of the resin used for the intermediate layer include urethane resin, acrylic resin, epoxy resin, and silicone resin. As the elastic material contained in the intermediate layer, materials similar to the elastic materials used for the elastic layer are used.

For example, from a viewpoint of setting the Poisson ratio in the above range, urethane resin is preferable as the binder material.

The intermediate layer is also a layer that contributes to the resistance adjustment of the conductive roll. For example, the volume resistance value of the intermediate layer in a case where a voltage of 100 V is applied is preferably equal to or more than $10^4$Ω and equal to or less than $10^9$Ω (more preferably equal to or more than $10^6$Ω and equal to or less than $10^9$Ω).

The volume resistance value of the intermediate layer is measured by a method similar to the method for the volume resistance value of the elastic layer.

For example, the intermediate layer preferably contains a conductive agent in order to achieve the above volume resistance value.

As the conductive agent, any of an electronic conductive agent and an ionic conductive agent is used. Among the agents, for example is preferable to use the ionic conductive agent from a viewpoint of improving charge retention.

For example, that is, the intermediate layer is preferable to contain the ionic conductive agent. Examples of the ionic conductive agent contained in the intermediate layer include conductive agents which are the same as the ionic conductive agents contained in the elastic foam, and the favorable examples is also similar.

The ionic conductive agent may be used singly, or in combination of two or more types.

The ionic conductive agent used for the intermediate layer may be a polymer material having ionic conductivity, such as epichlorohydrin rubber, epichlorohydrin-ethylene oxide copolymer rubber, and epichlorohydrin-ethylene oxide-allyl glycidyl ether ternary copolymer rubber.

The ionic conductive agent used for the intermediate layer may be a compound in which an ionic conductive agent is bonded to the termination of a polymer material such as resin.

The content of the ionic conductive agent may be in a range in which the above-described volume resistance value may be achieved.

For example, the content of the ionic conductive agent is preferably equal to or more than 0.1 part by mass and equal to or less than 5.0 parts by mass, and more preferably equal to or more than 0.5 parts by mass and equal to or less than 3.0 parts by mass, with respect to 100 parts by mass of the binder material.

The intermediate layer may contain other additives in accordance with physical properties and the like required for the intermediate layer.

Thickness of Intermediate Layer

In the conductive roll according to the present exemplary embodiment, the thickness of the intermediate layer may be determined in accordance with the use of the conductive roll.

From a viewpoint of obtaining the conductive roll that easily increases the parallelism of an image transferred to a recording medium, for example the thickness of the intermediate layer it is preferable to adjust to satisfy a relation of (the thickness Td of the elastic layer) > (the thickness Tm of the intermediate layer) > (the thickness Ts of the surface layer).

Specifically, the thickness of the intermediate layer may be adjusted so that the thickness Td of the elastic layer, for example the thickness Tm of the intermediate layer, and the thickness Ts of the surface layer it is preferable to adjust to satisfy a relation of $0.07 \leq Tm/(Td+Tm+Ts) \leq 0.43$ (particularly, relation of $0.08 \leq Tm/(Td+Tm+Ts) \leq 0.3$).

For example, the more specific thickness of the intermediate layer is preferably equal to or more than 0.5 mm and equal to or less than 5 mm, and more preferably equal to or more than 0.5 mm and equal to or less than 3 mm.

A method of forming the intermediate layer is not particularly limited. For example, a method of applying a coating liquid for forming an intermediate layer onto the elastic layer and drying the obtained coated film is exemplified.

Surface Layer

The surface layer is a layer disposed on the outer peripheral surface of the intermediate layer, and is a layer forming the outermost surface of the conductive roll.

For example, because the surface layer comes into contact with a medium, it is preferable that the surface layer has releasability.

For example, the surface layer is preferably a layer containing resin.

The resin contained in the surface layer is not particularly limited, and examples of such resin include urethane resin, polyester resin, phenol resin, acrylic resin, epoxy resin, and cellulose resin.

For example, the surface layer preferably contains a conductive agent.

Examples of the conductive agent contained in the surface layer include an electronic conductive agent and an ionic conductive agent.

As the electronic conductive agent contained in the surface layer, an electronic conductive agent similar to the electronic conductive agent used in the conductive coating layer is used. As the ionic conductive agent contained in the surface layer, an ionic conductive agent similar to the ionic conductive agent used in the intermediate layer is used.

The surface layer may contain other additives in accordance with physical properties and the like required for the surface layer.

Young's Modulus of Surface Layer

From a viewpoint of improving the cleanability, for example, the Young's modulus of the surface layer is preferably equal to or more than 10 MPa and equal to or less than 400 MPa, more preferably equal to or more than 50 MPa and equal to or less than 400 MPa, and further preferably equal to or more than 100 MPa and equal to or less than 350 MPa.

The Young's modulus of the surface layer is measured by a method similar to the method for the Young's modulus of the elastic layer. A dumbbell-type tensile test piece having a thickness of 0.2 mm is used. The dumbbell-type tensile test piece is obtained in a manner that the surface layer of a target conductive roll is analyzed, and a surface-layer material having the same composition as the analyzed composition is put into a resin mold having high releasability such as PTFE, is cured by heating, and then is detached from the mold.

Thickness of Surface Layer

In the conductive roll according to the present exemplary embodiment, the thickness of the surface layer may be determined in accordance with the use of the conductive roll.

From the viewpoint of improving the cleanability, for example, the thickness of the surface layer is preferably equal to or more than 10 μm and equal to or less than 50 μm, and more preferably equal to or more than 12 μm and equal to or less than 45 μm.

Volume Resistance Value of Surface Layer

For example, the volume resistance value of the surface layer in a case where a voltage of 10 V is applied is preferably equal to or more than $10^4\Omega$ and equal to or less than $10^{14}\Omega$, and more preferably equal to or more than $10^6\Omega$ and equal to or less than $10^{12}\Omega$.

The volume resistance value of the surface layer is measured in a manner as follows based on JIS K 6911.

First, the surface layer of a target conductive roll is analyzed, and a single-layer sheet member using a surface-layer material having the same composition as the analyzed composition is produced. Then, the volume resistivity is measured using the obtained sheet member. The thickness of the sheet member is set to 0.2 mm. The sheet member is placed between circular electrodes, and a voltage (V) of 10 V is applied between a front electrode and a back electrode by using a minute current measuring device (R8320 manufactured by Advantest CORPORATION). Then, a current value I (A) after 5 seconds is read, and the volume resistance value is obtained by calculation with the following expression.

Expression: Volume resistance value Rv $(\Omega)=V/I$

A method of forming the surface layer is not particularly limited. For example, a method of applying a coating liquid for forming a surface layer onto the intermediate layer and drying the obtained coated film is exemplified.

Volume Resistance Value of Conductive Roll

In the conductive roll according to the present exemplary embodiment, for example, the volume resistance value in a case where a voltage of 1000 V is applied to the conductive roll is preferably equal to or more than $10^4\Omega$ and equal to or less than $10^{12}\Omega$, more preferably equal to or more than $10^5\Omega$ and equal to or less than $10^{11}\Omega$, and further preferably equal to or more than $10^6\Omega$ and equal to or less than $10^{10}\Omega$.

The volume resistance value of the conductive roll is measured in a manner similar to the method for the volume resistance value of the elastic layer.

Volume Resistance Value of Conductive Roll

In the conductive roll according to the present exemplary embodiment, for example, the volume resistance value in a case where a voltage of 1000 V is applied to the conductive roll is preferably equal to or more than $10^4\Omega$ and equal to or less than $10^{12}\Omega$, more preferably equal to or more than $10^5\Omega$ and equal to or less than $10^{11}\Omega$, and further preferably equal to or more than $10^6\Omega$ and equal to or less than $10^{10}\Omega$.

The volume resistance value of the conductive roll is measured in a manner similar to the method for the volume resistance value of the elastic layer.

Image Forming Apparatus, Transfer Device, and Process Cartridge

Figure 4:
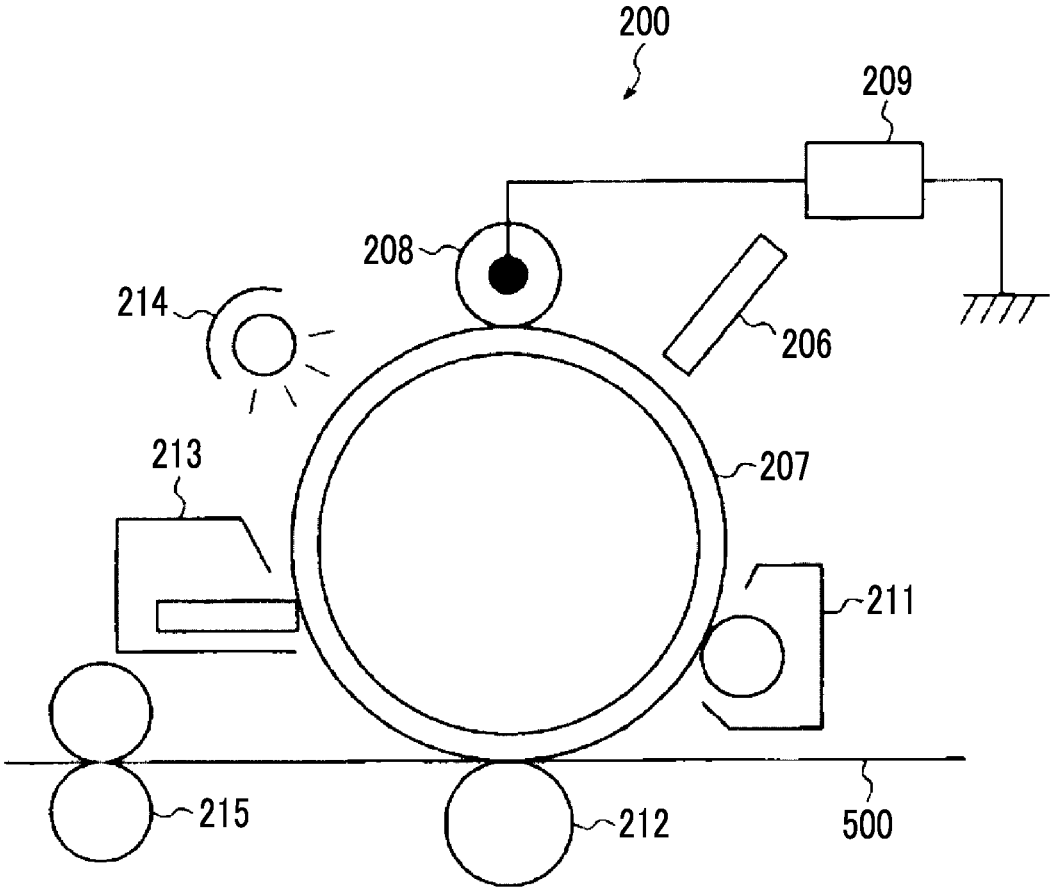
FIG. 4 is a schematic configuration diagram illustrating an example of an image forming apparatus according to the present exemplary embodiment.

FIG. 4 is a schematic configuration diagram illustrating a direct transfer type image forming apparatus which is an example of an image forming apparatus according to the present exemplary embodiment.

An image forming apparatus 200 illustrated in FIG. 4 includes a photoconductor 207 (an example of an image holding member), a charging roll 208 (an example of charging means), an exposure device 206 (an example of electrostatic charge image forming means), a developing device 211 (an example of development means), and a transfer roll 212 (an example of transfer means and an example of a transfer device according to the present exemplary embodiment). The charging roll 208 charges the surface of the photoconductor 207. The exposure device 206 forms an electrostatic charge image on the charged surface of the photoconductor 207. The developing device 211 develops the electrostatic charge image formed on the surface of the photoconductor 207, as a toner image, with a developer containing a toner. The transfer roll 212 transfers the toner image formed on the surface of the photoconductor 207, to the surface of a recording medium.

Here, the conductive roll according to the present exemplary embodiment is applied to the transfer roll 212 that forms an insertion portion through which recording paper 500 is inserted, by pressing the outer peripheral surface against the photoconductor 207 corresponding to the facing roll.

The image forming apparatus 200 illustrated in FIG. 4 further includes a cleaning device 213, an erasing device 214, and a fixing device 215 (an example of fixing means). The cleaning device 213 removes the toner remaining on the surface of the photoconductor 207. The erasing device 214 erases the electricity of the surface of the photoconductor 207. The fixing device 215 fixes the toner image to a recording medium.

The charging roll 208 may be a contact charging type or a non-contact charging type. A voltage from a power source 209 is applied to the charging roll 208.

Examples of the exposure device 206 include an optical device including a light source such as a semiconductor laser and a light emitting diode (LED).

The developing device 211 is a device that supplies a toner to the photoconductor 207. For example, the developing device 211 brings a roll-shaped developer holding member in contact with or close to the photoconductor 207, and adheres the toner to the electrostatic charge image on the photoconductor 207 to form a toner image.

The transfer roll 212 is a transfer roll that comes into direct contact with the surface of a recording medium, and is disposed at a position facing the photoconductor 207. The recording paper 500 (an example of a recording medium) is supplied to a gap at which the transfer roll 212 and the photoconductor 207 are in contact with each other, through a supply mechanism. In a case where a transfer bias is applied to the transfer roll 212, an electrostatic force from the photoconductor 207 toward the recording paper 500 acts on the toner image, and the toner image on the photoconductor 207 is transferred to the recording paper 500.

Examples of the fixing device 215 include a heating fixing device including a heating roll and a pressure roll that presses against the heating roll.

Examples of the cleaning device 213 include devices including blades, brushes, rolls, and the like as cleaning members.

The erasing device 214 is, for example, a device that irradiates the surface of the photoconductor 207 after the transfer with light to erase the residual potential of the photoconductor 207.

The photoconductor 207 and the transfer roll 212 may have, for example, a cartridge structure (process cartridge according to the present exemplary embodiment) in which the photoconductor 207 and the transfer roll 212 are integrated by one housing. The cartridge structure is attachable to and detachable from the image forming apparatus. The cartridge structure (process cartridge according to the present exemplary embodiment) may further include at least one selected from the group consisting of the charging roll 208, the exposure device 206, the developing device 211, and the cleaning device 213.

The image forming apparatus is a tandem type image forming apparatus in which a photoconductor 207, a charging roll 208, an exposure device 206, a developing device 211, a transfer roll 212, and a cleaning device 213 are used as one image forming unit, and a plurality of the image forming units are mounted side by side.

Figure 5:
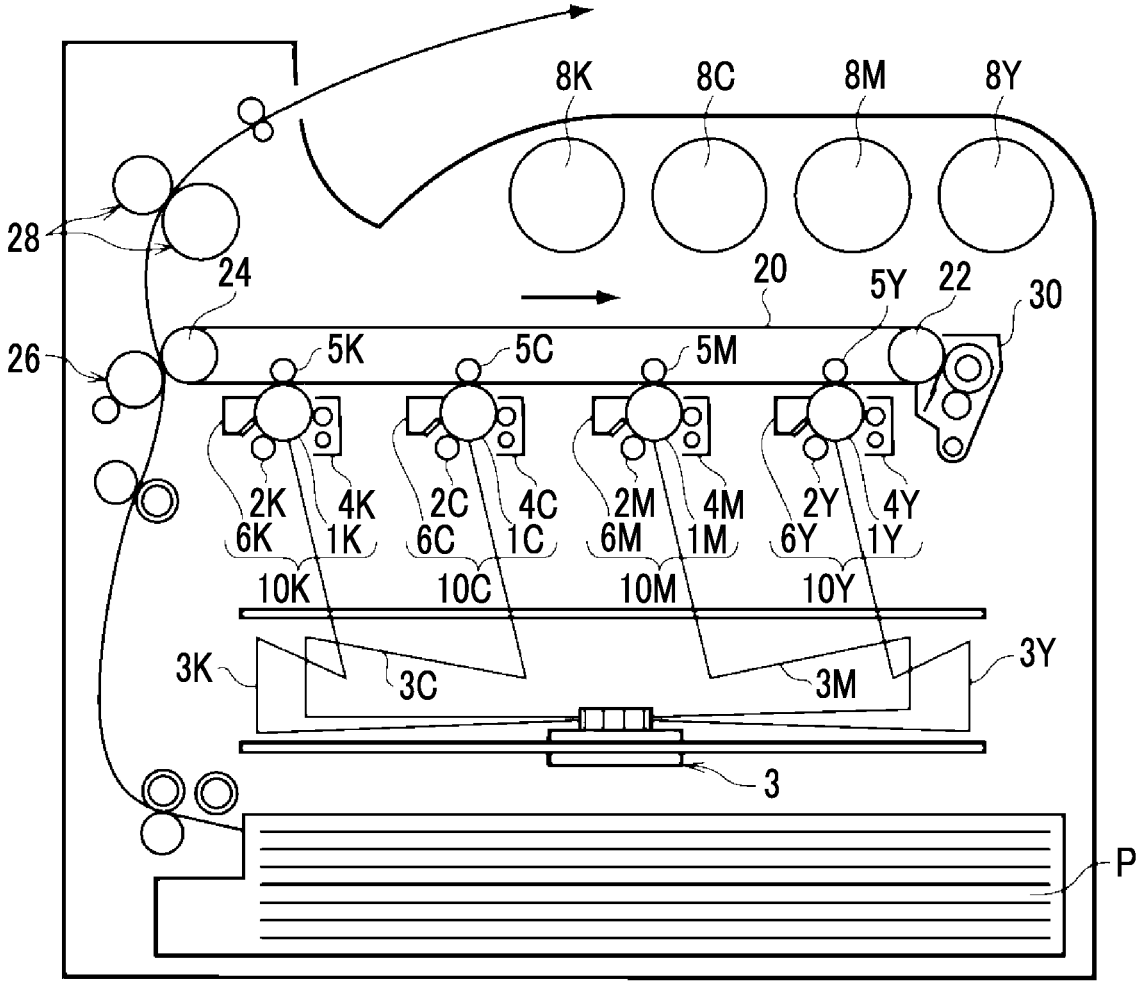
FIG. 5 is a schematic configuration diagram illustrating another example of the image forming apparatus in the present exemplary embodiment.

FIG. 5 is a schematic configuration diagram illustrating an intermediate transfer type image forming apparatus which is an example of an image forming apparatus according to the present exemplary embodiment. The image forming apparatus illustrated in FIG. 5 is a tandem type image forming apparatus in which four image forming units are arranged in parallel.

In the image forming apparatus illustrated in FIG. 5, the transfer means for transferring the toner image formed on the surface of the image holding member to the surface of the recording medium is configured as a transfer unit (an example of the transfer device according to the present exemplary embodiment) that includes an intermediate transfer member, primary transfer means, and secondary transfer means. The transfer unit may have a cartridge structure that is attachable to and detachable from the image forming apparatus.

The image forming apparatus illustrated in FIG. 5 includes a photoconductor 1 (an example of the image holding member), a charging roll 2 (an example of the charging means), an exposure device 3 (an example of the electrostatic charge image forming means), a developing device 4 (an example of the development means), an intermediate transfer belt 20 (an example of the intermediate transfer member), a primary transfer roll 5 (an example of the primary transfer means), and a secondary transfer roll 26 (an example of the secondary transfer means). The charging roll 2 charges the surface of the photoconductor 1. The exposure device 3 forms an electrostatic charge image on the charged surface of the photoconductor 1. The developing device 4 develops the electrostatic charge image formed on the surface of the photoconductor 1, as a toner image, with a developer containing a toner. The primary transfer roll 5 transfers the toner image formed on the surface of the photoconductor 1, to the surface of the intermediate transfer belt 20. The secondary transfer roll 26 transfers the toner image transferred to the surface of the intermediate transfer belt 20, to the surface of a recording medium.

Here, the conductive roll according to the present exemplary embodiment is applied to the secondary transfer roll 26 that forms an insertion portion through which recording paper P is inserted, by pressing the outer peripheral surface against a support roll 24 corresponding to the facing roll.

The image forming apparatus illustrated in FIG. 5 further includes a fixing device 28 (an example of the fixing means), a photoconductor cleaning device 6, and an intermediate-transfer-belt cleaning device 30. The fixing device 28 fixes the toner image to the recording medium. The photoconductor cleaning device 6 removes the toner remaining on the surface of the photoconductor 1. The intermediate-transfer-belt cleaning device 30 removes the toner remaining on the surface of the intermediate transfer belt 20.

The image forming apparatus illustrated in FIG. 5 includes first to fourth electrophotographic image forming units 10Y, 10M, 10C, and 10K that output images of colors of yellow (Y), magenta (M), cyan (C), and black (K) based on color-separated pieces of image data. The image forming units 10Y, 10M, 10C, and 10K are arranged side by side so as to be spaced from each other in a horizontal direction. The image forming units 10Y, 10M, 10C, and 10K may be process cartridges that are attachable to and detachable from the image forming apparatus, respectively.

The intermediate transfer belt 20 is provided above the image forming units 10Y, 10M, 10C, and 10K to extend with passing by the image forming units. The intermediate transfer belt 20 is provided by being wound around a drive roll 22 and the support roll 24 that are in contact with the inner surface of the intermediate transfer belt 20. The intermediate transfer belt 20 travels in a direction from the first image forming unit 10Y to the fourth image forming unit 10K. A force is applied to the support roll 24 in a direction away from the drive roll 22 by a spring or the like (not illustrated), and tension is applied to the intermediate transfer belt 20 wound around both the support roll 24 and the drive roll 22. The intermediate-transfer-belt cleaning device 30 is provided on an image holding surface side of the intermediate transfer belt 20 to face the drive roll 22.

Yellow, magenta, cyan, and black toners contained in toner cartridges 8Y, 8M, 8C, and 8K are supplied to developing devices 4Y, 4M, 4C, and 4K of the image forming units 10Y, 10M, 10C, and 10K, respectively.

The first to fourth image forming units 10Y, 10M, 10C, and 10K have the equivalent configuration and operation. Thus, in a case where the image forming unit is described, the first image forming unit 10Y will be described below as the representative.

The first image forming unit 10Y includes a photoconductor 1Y, a charging roll 2Y, a developing device 4Y, a primary transfer roll 5Y, and a photoconductor cleaning device 6Y. The charging roll 2Y charges the surface of the photoconductor 1Y. The developing device 4Y develops an electrostatic charge image formed on the surface of the photoconductor 1Y, as a toner image, with a developer containing a toner. The primary transfer roll 5Y transfers the toner image formed on the surface of the photoconductor 1Y, to the surface of the intermediate transfer belt 20. The photoconductor cleaning device 6Y removes the toner remaining on the surface of the photoconductor 1Y after the primary transfer.

The charging roll 2Y charges the surface of the photoconductor 1Y. The charging roll 2Y may be a contact charging type or a non-contact charging type.

The charged surface of the photoconductor 1Y is irradiated with a laser beam 3Y from the exposure device 3. Thus, an electrostatic charge image having a yellow image pattern is formed on the surface of the photoconductor 1Y.

In the developing device 4Y, for example, an electrostatic charge image developer containing at least a yellow toner and a carrier is stored. The yellow toner is triboelectrically charged by being agitated in the developing device 4Y. Because the surface of the photoconductor 1Y passes by the developing device 4Y, the electrostatic charge image formed on the photoconductor 1Y is developed as a toner image.

The primary transfer roll 5Y is disposed on the inner side of the intermediate transfer belt 20 and is disposed at a position facing the photoconductor 1Y. A bias power source (not illustrated) for applying a primary transfer bias is connected to the primary transfer roll 5Y. The primary transfer roll 5Y transfers the toner image on the photoconductor 1Y to the intermediate transfer belt 20 by an electrostatic force.

Toner images of the colors are multiplex-transferred on the intermediate transfer belt 20 in order from the first to fourth image forming units 10Y, 10M, 10C, and 10K. The intermediate transfer belt 20 on which the toner images of four colors are multiplex-transferred through the first to fourth image forming units reaches the secondary transfer means configured by the support roll 24 and the secondary transfer roll 26.

The secondary transfer roll 26 is a transfer roll that is in direct contact with the surface of the recording medium, and is disposed at a position facing the support roll 24 on the outside of the intermediate transfer belt 20. The recording paper P (an example of a recording medium) is supplied to the gap where the secondary transfer roll 26 and the intermediate transfer belt 20 are in contact with each other via the supply mechanism. In a case where a secondary transfer bias is applied to the secondary transfer roll 26, an electrostatic force from the intermediate transfer belt 20 toward the recording paper P acts on the toner image, and thus the toner image on the intermediate transfer belt 20 is transferred to the recording paper P.

The recording paper P on which the toner image is transferred is delivered to a nip portion of the fixing device 28 configured by a pair of rolls, and the toner image is fixed on the recording paper P.

The toner and the developer used in the image forming apparatus according to the present exemplary embodiment are not particularly limited, and any known electrophotographic toner and any known developer can be used.

The recording medium used in the image forming apparatus according to the present exemplary embodiment is not particularly limited, and examples of the recording medium include paper used in electrophotographic copying machines and printers; and OHP sheets.

EXAMPLES

Examples will be described below, but the present invention is not limited to the examples. In the following description, unless otherwise specified, "parts" and are all based on the mass.

Example 1

Formation of Elastic Layer

Formation of Elastic Foam

EP70 (urethane foam manufactured by Inoac Corporation) is used as the elastic foam. EP70 is cut into a cylindrical shape having an outer diameter of 26 mm and an inner diameter of 14 mm to obtain a cylindrical elastic foam.

The obtained elastic foam has an open cell structure, a cell diameter of 400 μm, and density of 70 kg/m$^3$.

Formation of Conductive Coating Layer

The elastic foam obtained by the above method is immersed in a treatment liquid at 20° C. for 10 minutes. In the above treatment liquid, an aqueous dispersion in which 36% by mass of carbon black are contained and dispersed, and an acrylic emulsion (manufactured by Nippon Zeon Corporation, product name "Nipol LX852") are mixed at a mass ratio of 1:1.

Then, the elastic foam to which the treatment liquid is attached is heated and dried in a curing furnace set at 100° C. for 60 minutes to remove water and crosslink acrylic resin. A conductive coating layer containing carbon black is formed on the exposed surface of the elastic foam by the acrylic resin cured by crosslinking.

In this manner, an elastic layer configured by the elastic foam and the conductive coating layer that covers the exposed surface of the elastic foam is obtained.

Then, a roll member is formed by inserting a conductive support member (made of SUS, diameter of 14 mm) having a surface to which an adhesive is applied, to the obtained elastic layer.

Formation of Intermediate Layer 70 parts of an urethane oligomer (manufactured by Nippon Synthetic Chemical Co., Ltd., urethane acrylate UV3700B), 30 parts of an urethane monomer (manufactured by Kyoeisha Chemical Co., Ltd., isomiristyl acrylate), 0.5 parts of a polymerization initiator (manufactured by Ciba Specialty Chemicals Co., Ltd., 1-hydroxycyclohexylphenyl ketone Irgacure 184), and 3 parts of alkyltrimethylammonium percolate (product name "LXN-30" manufactured by Daiso Co., Ltd.) are mixed to obtain a coating liquid for forming an intermediate layer. The obtained coating liquid for forming an intermediate layer is applied onto the elastic layer by using a die coater, and the coated film is UV-irradiated for 5 seconds with UV irradiation intensity of 700 mW/cm$^2$ while rotating. With this work, an intermediate layer having a thickness of 1 mm is formed.

Formation of Surface Layer

Subsequently, 5% by mass of a curing agent (WH-1, manufactured by Henkel Japan Ltd.) are added to a urethane resin coating material (EMRALON T-862A, manufactured by Henkel Japan Ltd.), and mixed to obtain a coating liquid for forming a surface layer. The obtained coating liquid for forming a surface layer is applied onto the intermediate layer by spray coating, and the coated film is heated and cured at 120° C. for 20 minutes to form a surface layer having a thickness of 20 μm.

In this manner, a conductive roll having a volume resistance value of $10^{6.8}\Omega$ (measured value in a case where 1000 V is applied) is obtained.

Example 2

A conductive roll is obtained in a manner similar to the manner in Example 1 except that the coated film is UV-irradiated for 5 seconds with UV irradiation intensity of 650 mW/cm$^2$ in a case where the intermediate layer is formed.

Example 3

A conductive roll is obtained in a manner similar to the manner in Example 1 except that the coated film is UV-irradiated for 5 seconds with UV irradiation intensity of 600 mW/cm$^2$ in a case where the intermediate layer is formed.

Example 4

A conductive roll is obtained in a manner similar to the manner in Example 2 except that a surface layer having a thickness of 40 μm is formed by using ST-008E (manufactured by Ube Industries, Ltd.) as the urethane resin coating material of the surface layer.

Example 5

A conductive roll is obtained in a manner similar to the manner in Example 2 except that EP69 (urethane foam manufactured by Inoac Corporation) is used as the elastic foam when the elastic layer is formed, and a surface layer having a thickness of 8 μm is formed.

Example 6

A conductive roll is obtained in a manner similar to the manner in Example 2 except that a surface layer having a thickness of 10 μm is formed.

Example 7

A conductive roll is obtained in a manner similar to the manner in Example 2 except that a surface layer having a thickness of 60 μm is formed.

Example 8

A conductive roll is obtained in a manner similar to the manner in Example 2 except that EP70 (urethane foam manufactured by Inoac Corporation) is used as the elastic foam when the elastic layer is formed, carbon black is kneaded into urethane resin in advance and then foamed, and a conductive coating layer is not formed.

Example 9

A conductive roll is obtained in a manner similar to the manner in Example 2 except that RMM (urethane foam manufactured by Inoac Corporation) is used as the elastic foam when the elastic layer is formed.

Example 10

A conductive roll is obtained in a manner similar to the manner in Example 2 except that an elastic layer is formed as described below.

Formation of Elastic Layer

Formation of Elastic Foam 60 parts of EPDM (ethylene-propylene-diene rubber, ESPRENE 505 manufactured by Sumitomo Chemical Co., Ltd.) as a rubber component are kneaded by a pressure kneader. 7 parts of 4,4'-oxybisbenzenesulfonylhydrazide (OBSH) as a chemical foaming agent, 12 parts of acetylene black (manufactured by Denka Company Ltd., DBP oil absorption=212 ml/100 g) as a conductive agent, 23 parts of thermal black (manufactured by Asahi Carbon, DBP oil absorption=103 ml/100 g), 5 parts of zinc oxide (manufactured by NIPPON CHEMICAL INDUSTRIAL CO., LTD.) as a filler, 1.5 parts of a vulcanization accelerator (NOCCELER TS, manufactured by OUCHI SHINKO CHEMICAL INDUSTRIAL CO., LTD.), and 1.5 parts of a vulcanization accelerator (NOCCELER DT, manufactured by OUCHI SHINKO CHEMICAL INDUSTRIAL CO., LTD.) are added and further kneaded with two heating rolls. The mixture is inserted into a SUS core metal (14 mmφ) and foam-molded into a roll to form a roll member.

Formation of Conductive Coating Layer

The elastic foam obtained by the above method is immersed in a treatment liquid at 20° C. for 10 minutes. In the above treatment liquid, an aqueous dispersion in which 36% by mass of carbon black are contained and dispersed, and an acrylic emulsion (manufactured by Nippon Zeon Corporation, product name "Nipol LX852") are mixed at a mass ratio of 1:1.

Then, the elastic foam to which the treatment liquid is attached is heated and dried in a curing furnace set at 100° C. for 60 minutes to remove water and crosslink acrylic resin. A conductive coating layer containing carbon black is formed on the exposed surface of the elastic foam by the acrylic resin cured by crosslinking.

In this manner, an elastic layer configured by the elastic foam and the conductive coating layer that covers the exposed surface of the elastic foam is obtained.

Examples 11 to 15

A conductive roll is obtained in a manner similar to the manner in Example 1 except that the thicknesses of the elastic layer and the intermediate layer are changed to values shown in Table 1.

Example 16

A conductive roll is obtained in a manner similar to the manner in Example 1 except that "UW-2001A" (manufactured by Ube Industries, Ltd.) is used as the urethane resin coating material of the surface layer.

Examples 17 to 19

Conductive rolls are obtained in a manner similar to the manner in Example 1 except that PE-Lite A-8 (polyethylene foam manufactured by Inoac Corporation), RR26 (urethane foam manufactured by Inoac Corporation), and RR90 (urethane foam manufactured by Inoac Corporation) are respectively used as the elastic foam when the elastic layer is formed.

Comparative Example 1

A conductive roll is obtained in a manner similar to the manner in Example 1 except that the coated film is UV-irradiated for 5 seconds with UV irradiation intensity of 850 mW/cm$^2$ in a case where the intermediate layer is formed.

Comparative Example 2

A conductive roll is obtained in a manner similar to the manner in Example 9 except that the coated film is UV-irradiated for 5 seconds with UV irradiation intensity of 850 mW/cm$^2$ in a case where the intermediate layer is formed.

Evaluation

Parallelism of Image Transferred to Recording Medium

Using ApeosPort VII C6688 manufactured by Fuji Xerox, the pushing amount of the secondary transfer roll onto the facing intermediate transfer belt is set to Rear 0.2 mm and Front 0.8 mm, and a difference of 0.6 mm is applied to the pushing amount (Rear)-(Front). In this manner, the secondary transfer roll is installed. A rectangular line of 280 mm×400 mm in the A3 size is formed on the intermediate transfer belt. This line is transferred by a secondary transfer unit and is fixed by a fixing device. Then, an image line length ($L_{Rear}$, $L_{Front}$) on the Rear side and the Front side of an output image is measured, and an image length difference ($L_{Front}$)−($L_{Rear}$) from the original image length of 400 mm is calculated, and thus the parallelism ΔL is calculated (see FIG. 1B).

Evaluation Criteria

A (○): ΔL>1.5 mm
B (Δ): 0.5 mm<ΔL<1.5 mm
C (×): 0.5 mm>ΔL

Cleanability

A produced secondary transfer roll is installed on ApeosPort VII C6688 manufactured by Fuji Xerox, and a solid image of K100% is output on one side of A3 paper. The back surface of output paper after 100 sheets of images are output is observed, and the toner stains on the back surface are checked.

Evaluation Criteria

A (○): the back surface is not dirty at all.
B (Δ): a portion of the back surface is colored black.
C (×): the back surface is colored black in a band shape.

[Table 1]

| | Elastic layer | | | | Intermediate layer | Surface layer | Thickness of layers | | | | Evaluation | |
|---|---|---|---|---|---|---|---|---|---|---|---|---|
| | Material type | Conduction method | Cell structure | Density (Kg/m3) | Poisson ratio | Young modulus (Mpa) | Elastic layer Td [mm] | Intermediate layer Tm [mm] | Surface layer Ts [μm] | Tm/(Td + Tm + Ts) | Parallelism of image | Cleanability |
| Example 1 | Urethane (EP70) | Coating | Open Cell | 70 | 0.4 | 250 | 6 | 1 | 15 | 0.143 | A○ | A○ |
| Example 2 | Urethane (EP70) | Coating | Open Cell | 70 | 0.35 | 250 | 6 | 1 | 15 | 0.143 | A○ | A○ |
| Example 3 | Urethane (EP70) | Coating | Open Cell | 70 | 0.3 | 250 | 6 | 1 | 15 | 0.143 | A○ | A○ |
| Example 4 | Urethane (EP70) | Coating | Open Cell | 70 | 0.35 | 310 | 6 | 1 | 40 | 0.142 | A○ | A○ |
| Example 5 | Urethane (EP69) | Coating | Open Cell | 70 | 0.35 | 250 | 6 | 1 | 8 | 0.143 | A○ | C× (cracks) |
| Example 6 | Urethane (EP70) | Coating | Open Cell | 70 | 0.35 | 250 | 6 | 1 | 10 | 0.143 | A○ | A○ |
| Example 7 | Urethane (EP70) | Coating | Open Cell | 70 | 0.35 | 250 | 6 | 1 | 60 | 0.142 | A○ | C× (cracks) |
| Example 8 | Urethane (EP70) | Kneading | Open Cell | 70 | 0.35 | 250 | 6 | 1 | 15 | 0.143 | BΔ | A○ |

-continued

| | Elastic layer | | | | Inter-mediate layer | Surface layer | Thickness of layers | | | | Evaluation | |
|---|---|---|---|---|---|---|---|---|---|---|---|---|
| | Material type | Conduction method | Cell structure | Density (Kg/m3) | Poisson ratio | Young modulus (Mpa) | Elastic layer Td [mm] | Inter-mediate layer Tm [mm] | Surface layer Ts [μm] | Tm/(Td + Tm + Ts) | Paral-lelism of image | Clean-ability |
| Example 9 | Urethane (RMM) | Coating | Open Cell | 55 | 0.35 | 250 | 6 | 1 | 15 | 0.143 | A○ | A○ |
| Example 10 | EPDM | Coating | Open Cell | 65 | 0.35 | 250 | 6 | 1 | 15 | 0.143 | A○ | A○ |
| Example 11 | Urethane (EP70) | Coating | Open Cell | 70 | 0.4 | 250 | 3 | 4 | 15 | 0.570 | BΔ | A○ |
| Example 12 | Urethane (EP70) | Coating | Open Cell | 70 | 0.4 | 250 | 6.7 | 0.3 | 15 | 0.043 | BΔ | A○ |
| Example 13 | Urethane (EP70) | Coating | Open Cell | 70 | 0.4 | 250 | 4 | 3 | 15 | 0.428 | BΔ | A○ |
| Example 14 | Urethane (EP70) | Coating | Open Cell | 70 | 0.4 | 250 | 6.6 | 0.4 | 15 | 0.570 | BΔ | A○ |
| Example 15 | Urethane (EP70) | Coating | Open Cell | 70 | 0.4 | 250 | 4 | 3 | 15 | 0.428 | BΔ | A○ |
| Example 16 | Urethane (EP70) | Coating | Open Cell | 70 | 0.4 | 9 | 6 | 1 | 15 | 0.143 | BΔ | A○ |
| Example 17 | A-8 (PE) | Coating | Closed Cell | 64 | 0.4 | 250 | 6 | 1 | 15 | 0.143 | BΔ | A○ |
| Example 18 | RR26 | Coating | Open Cell | 35 | 0.4 | 250 | 6 | 1 | 15 | 0.143 | BΔ | A○ |
| Example 19 | RR90 | Coating | Open Cell | 92 | 0.4 | 250 | 6 | 1 | 15 | 0.143 | BΔ | A○ |
| Comparative example 1 | Urethane (EP70) | Coating | Open Cell | 70 | 0.45 | 250 | 12 | 1 | 15 | 0.077 | C× | A○ |
| Comparative example 2 | EPDM | Coating | Open Cell | 65 | 0.45 | 250 | 12 | 1 | 15 | 0.077 | C× | A○ |

From the above results, it can be understood that the conductive rolls in the examples increases the parallelism of an image transferred to a recording medium more easily than the conductive rolls in the comparative examples.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A conductive roll comprising:

a support member;

an elastic layer disposed on an outer peripheral surface of the support member;

a surface layer disposed on an outer peripheral surface of the elastic layer; and an intermediate layer disposed between the elastic layer and the surface layer, the intermediate layer having a Poisson ratio of 0.40 or less, wherein a thickness Td of the elastic layer, a thickness Tm of the intermediate layer, and a thickness Ts of the surface layer satisfy a relation of $0.07 \leq Tm/(Td+Tm+Ts) \leq 0.43$.

2. The conductive roll according to claim 1, wherein the thickness Td of the elastic layer, the thickness Tm of the intermediate layer, and the thickness Ts of the surface layer satisfy a relation of $Td > Tm > Ts$.

3. The conductive roll according to claim 2, wherein the thickness Tm of the intermediate layer is equal to or more than 0.5 mm and equal to or less than 4 mm.

4. The conductive roll according to claim 2, wherein the thickness Ts of the surface layer is equal to or more than 10 μm and equal to or less than 50 μm.

5. The conductive roll according to claim 3, wherein the thickness Ts of the surface layer is equal to or more than 10 μm and equal to or less than 50 μm.

6. The conductive roll according to claim 1, wherein a Young's modulus Ys of the surface layer is equal to or more than 10 MPa and equal to or less than 400 MPa.

7. The conductive roll according to claim 2, wherein a Young's modulus Ys of the surface layer is equal to or more than 10 MPa and equal to or less than 400 MPa.

8. The conductive roll according to claim 4, wherein a Young's modulus Ys of the surface layer is equal to or more than 10 MPa and equal to or less than 400 MPa.

9. The conductive roll according to claim 1, wherein the elastic layer is configured to include a cylindrical elastic foam and a conductive coating layer that covers an exposed surface of the elastic foam.

10. The conductive roll according to claim 9, wherein the elastic foam has an open cell structure.

11. The conductive roll according to claim 9, wherein density of the elastic foam is equal to or more than 50 $kg/m^3$ and equal to or less than 90 $kg/m^3$.

12. A transfer device comprising:

the conductive roll according to claim 1.

13. A process cartridge attachable to and detachable from an image forming apparatus, the process cartridge comprising:

an image holding member; and the transfer device according to claim 12.

14. An image forming apparatus comprising:

an image holding member;

a charging device that charges a surface of the image holding member;

an electrostatic latent image forming device that forms an electrostatic latent image on the charged surface of the image holding member;

a developing device that develops the electrostatic latent image formed on the surface of the image holding member with a developer containing a toner to form a toner image; and the transfer device according to claim 12, that transfers the toner image to a surface of a recording medium.

* * * * *